United States Patent [19]

Collins

[11] Patent Number: 5,058,519

[45] Date of Patent: Oct. 22, 1991

[54] EMERGENCY DAMAGE PATCH AND METHOD FOR BOATS OR THE LIKE

[76] Inventor: Denny L. Collins, 935 Marine Drive, Bellingham, Wash. 98225

[21] Appl. No.: 502,832

[22] Filed: Apr. 2, 1990

[51] Int. Cl.[5] ..... B63B 43/16

[52] U.S. Cl. ..... 114/227; 29/402.09; 29/402.14; 137/15

[58] Field of Search ..... 114/227, 228; 52/514; 137/15; 24/16 PB; 138/98; 29/402.09, 402.14

[56] References Cited

U.S. PATENT DOCUMENTS

| | | | |
|---|---|---|---|
| 1,195,013 | 8/1916 | Heiggby . | |
| 1,249,422 | 12/1917 | Kook . | |
| 1,676,395 | 7/1928 | Korner . | |
| 2,220,085 | 11/1940 | Dirschel | 114/227 |
| 2,446,190 | 8/1948 | Oding | 114/227 |
| 2,476,601 | 7/1949 | Harper | 114/227 |
| 3,094,964 | 6/1963 | Witten et al. | 114/227 |
| 3,325,955 | 6/1967 | Haut | 52/514 |
| 3,605,199 | 9/1971 | Eberhardt | 24/16 PB |
| 4,016,696 | 4/1977 | Mess et al. | 52/514 |
| 4,075,809 | 2/1978 | Sirkin | 52/514 |
| 4,100,712 | 7/1978 | Hyman | 52/514 |
| 4,377,887 | 3/1983 | Valestin | 24/206 R |
| 4,385,582 | 5/1983 | Fuerst | 114/227 |
| 4,577,375 | 3/1986 | Beaussant | 24/580 |
| 4,646,401 | 3/1987 | Morell | 24/68 S K |
| 4,683,620 | 8/1987 | Valsecchi et al. | 24/715 K |
| 4,727,630 | 3/1988 | Alan | 24/585 |
| 4,780,939 | 11/1988 | Belter et al. | 24/585 |

FOREIGN PATENT DOCUMENTS

| | | |
|---|---|---|
| 534201 | 8/1958 | Belgium . |
| 189925 | 5/1906 | Fed. Rep. of Germany . |
| 0742939 | 1/1933 | France . |
| 2574890 | 12/1984 | France . |
| 286603 | 10/1952 | Switzerland . |
| 878-647 | 11/1981 | U.S.S.R. . |
| 984-925A | 1/1983 | U.S.S.R. . |
| 1110718 | 8/1984 | U.S.S.R. . |
| 543 | 1/1914 | United Kingdom . |
| 188561 | 11/1922 | United Kingdom . |

*Primary Examiner*—Sherman Basinger

[57] ABSTRACT

The specification disclosed an apparatus for covering-/patching a breach in a wall of a container such as a ship hull, which comprises: a sealing plate; an anchor comprising an arm that has a collapsed position and an extended position; and a substantially flexible strap fixed to the anchor and able to run through a strap securing device in the sealing plate. The anchor is positioned in its expanded position on one side of the wall, and the strap is passed through the breach to the other side of the wall where the strap rungs through the strap securing device in the plate. The plate is then positioned against the wall, and the strap is pulled until the plate is held tight against the wall to form a seal against a continable fluid.

21 Claims, 6 Drawing Sheets

EMERGENCY DAMAGE PATCH AND METHOD FOR BOATS OR THE LIKE

The present invention relates generally to methods and apparatus used to cover or patch cracks, holes, breaches, and the like, and more particularly, to such methods and apparatus used to cover breaches in fluid container walls, such as boat hulls.

BACKGROUND OF THE INVENTION

Containers, such as the hull of a boat or ship, sometimes experience damage in the form of breaks and the like in the hull wall, so that water is able to flow through the container wall. In many such cases it is highly desirable for the hole to be patched quickly. The patching operation may often be complicated by the problem of water rushing through the hole. Accordingly, there is a need for a patching device which is adapted to restore the hull temporarily and is quick acting and easy for one person to install. Such a device desirably will be versatile so that it may be used for different kinds of holes that foreseeably occur or holes having different area cross sections. Since it is foreseeable that the break may occur on portions of the hull that are uneven or rough, this device desirably will be adaptable for use on these uneven hull portions.

SUMMARY OF THE INVENTION

The present invention is designed to cover holes and other breaches, in a hull of a container, such as a boat or ship hull. It is embodied as an apparatus comprising a plate means, an anchor means, and a strap means fixed at one end to the anchor means.

In a preferred embodiment, a free end of the strap means is adapted to be pulled through a strap securing means in the plate means so that the distance between the anchor means and the plate means is able to varied. The strap means is substantially flexible, and being flexible it is adapted to allow freedom of movement of the plate means relative to the anchor means, and vice versa.

In the preferred form, the plate means is adapted to be pressed against the hull and to cover over the breach in the hull in a manner to form a seal against a containable fluid. The anchor means comprises one or more arm means which are able to be collapsed into a first collapsed position, or extended into a second extended position where the arms extend from a hub means of the anchor means. A spring means urges the arm means into the extended position.

In operation then, the anchor means, in its collapsed position, is able to pass through the breach and to expand on the other side of the breach to the expanded position. The plate means is able to be moved to a position where it covers the breach. Finally, the flexible strap means is able to be pulled through the conduit means so as to secure the plate means to the hull.

DESCRIPTION OF THE PREFERRED EMBODIMENT

It is believed that a better understanding of the present invention will be provided by first describing a problem which the invention is intended to solve, namely, covering or patching a hole in a ship's hull. This will be followed by a description of an inventive embodiment, after which further refinements and technical details will be described.

Figure 1:
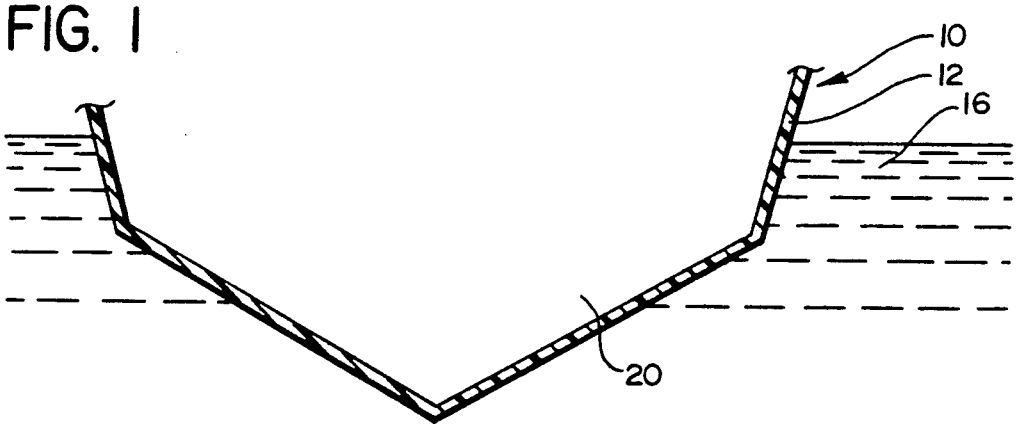
FIG. 1 is a schematic cross-section of a ship's hull in the water.
Figure 2:
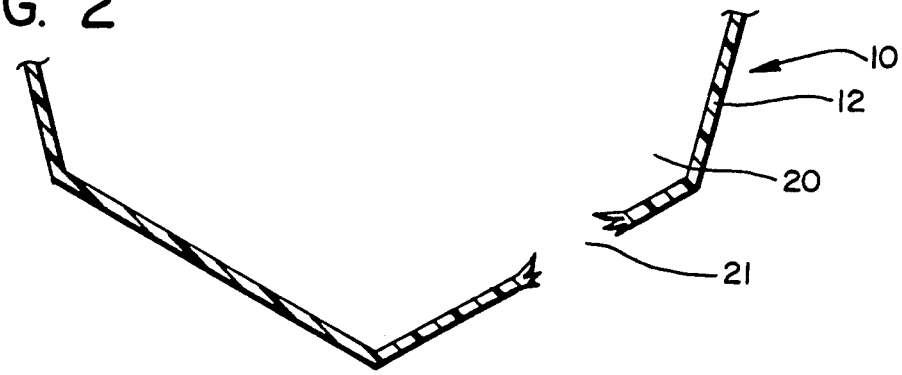
FIG. 2 is a view like FIG. 1, except that there is a hole or breach in the side of the ship below the water line.

1. An Example of An Application. FIGS. 1 and 2 show in section a ship 10, having a hull 12. When the hull 12 is punctured or otherwise damaged, sea water 16 is able to flow into an interior 20 of the ship 10, via an accidental hole 21. Among the difficulties that may be encountered in the operation of patching the hole 21 is the fact that the patching must often be performed quickly.

2. The Basic Patching Device. As shown in the perspective drawing of FIG. 3, the patching device 22 comprises a sealing plate 26, a flexible cord or strap 28, a right end of which is attached at an anchor attachment location 30 to a grapple-like clamp or anchor 32.

Figure 8:
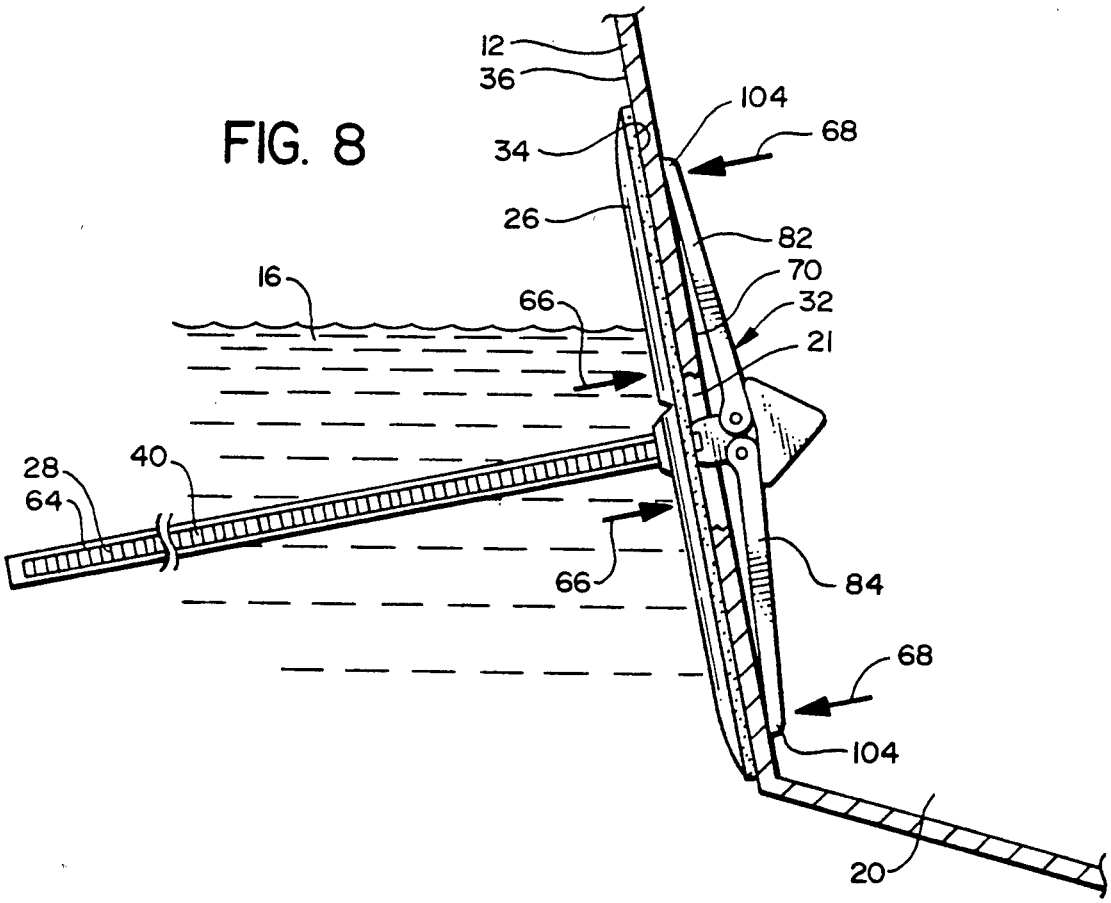
FIG. 8 is a view like FIGS. 6 and 7 in which the flexible strap of the apparatus has been pulled tightly so that the apparatus is clamped in a position to seal the hole.

The sealing plate 26 has a shape and an area that foreseeably will enable the sealing plate to cover the accidental hole 21 in the hull 12. A right sealing surface 34 of the sealing plate is able, when pressed against a left fluid exposed surface 36 shown in FIG. 8 of the hull 12, to form a seal against the seawater 16 so that the seawater is prevented from flowing through the accidental hole 21 into the interior 20 of the ship.

Figure 3:
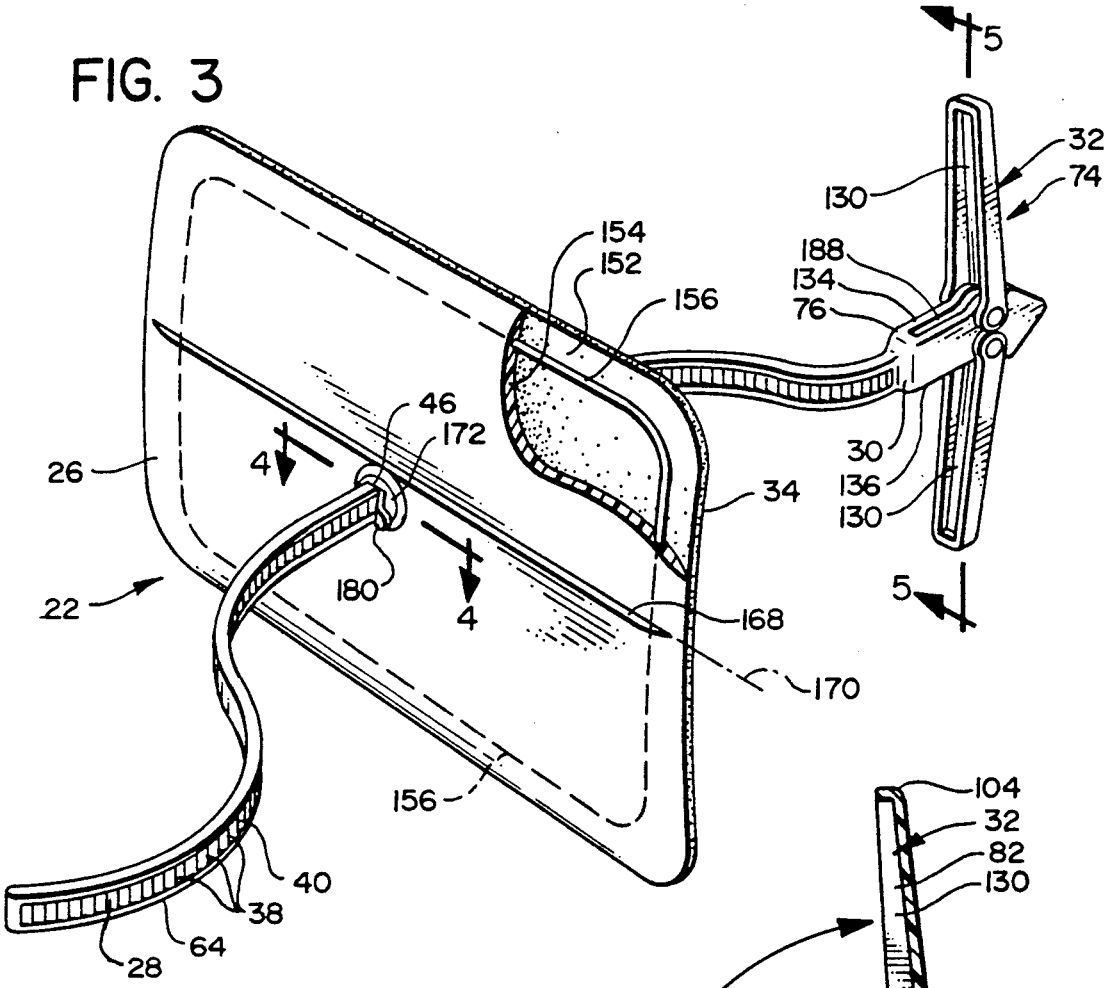
FIG. 3 is a perspective view of the apparatus of the present invention.

As shown in FIG. 3 the strap 28 is quite flexible along its entire length. It is also able to withstand substantial tension, such as occurs when pulled by a person who is using the device 22. It can be seen in the detailed view of FIG. 4 that the strap 28 comprises on one side thereof a series of identical protruding teeth 38 which define a ratchet surface 40 which runs along a strapwise axis 42 of the strap.

As shown best in the FIGS. 3 and 4, there is mounted to a ratchet engaging side 44 of a strap receiving hole or slot 46 in the sealing plate 26, a pawl or catch 48, which is biased toward a strap receiving area 50 of the slot 46 by biasing means 52 to be described later. Because of the interaction of the catch 48 and the ratchet surface 40 of the strap 28, the strap 28 is able to be pulled or moved leftwardly through the strap receiving slot 46 in the figures relatively easily, as indicated by the arrow 54, but is restrained from moving rightwardly at all or any more than a length of one of the teeth 38, before the catch 48 catches against the ratchet surface 40 so as to stop the rightward movement.

Figure 6:
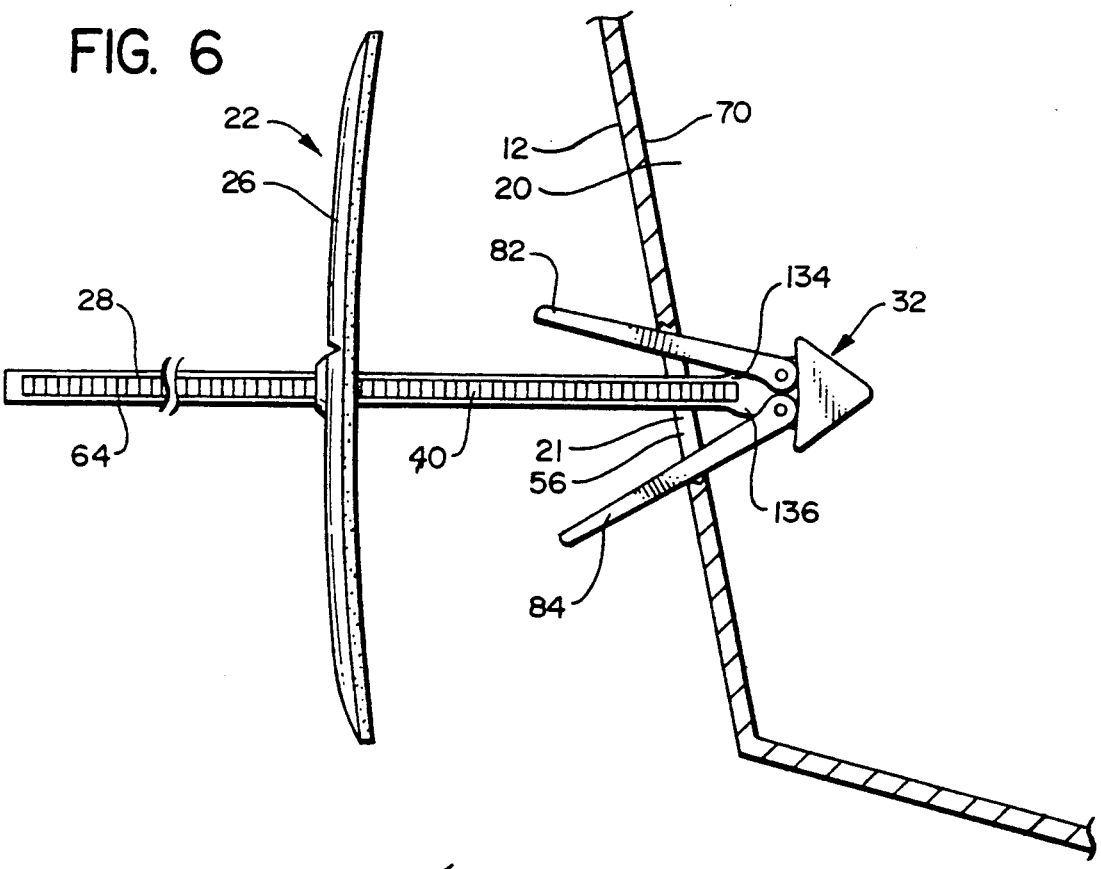
FIG. 6 is a view of the apparatus in an initial operative step in which a spring loaded anchor of the apparatus is inserted in the hole in the side of the ship previously shown.
Figure 7:
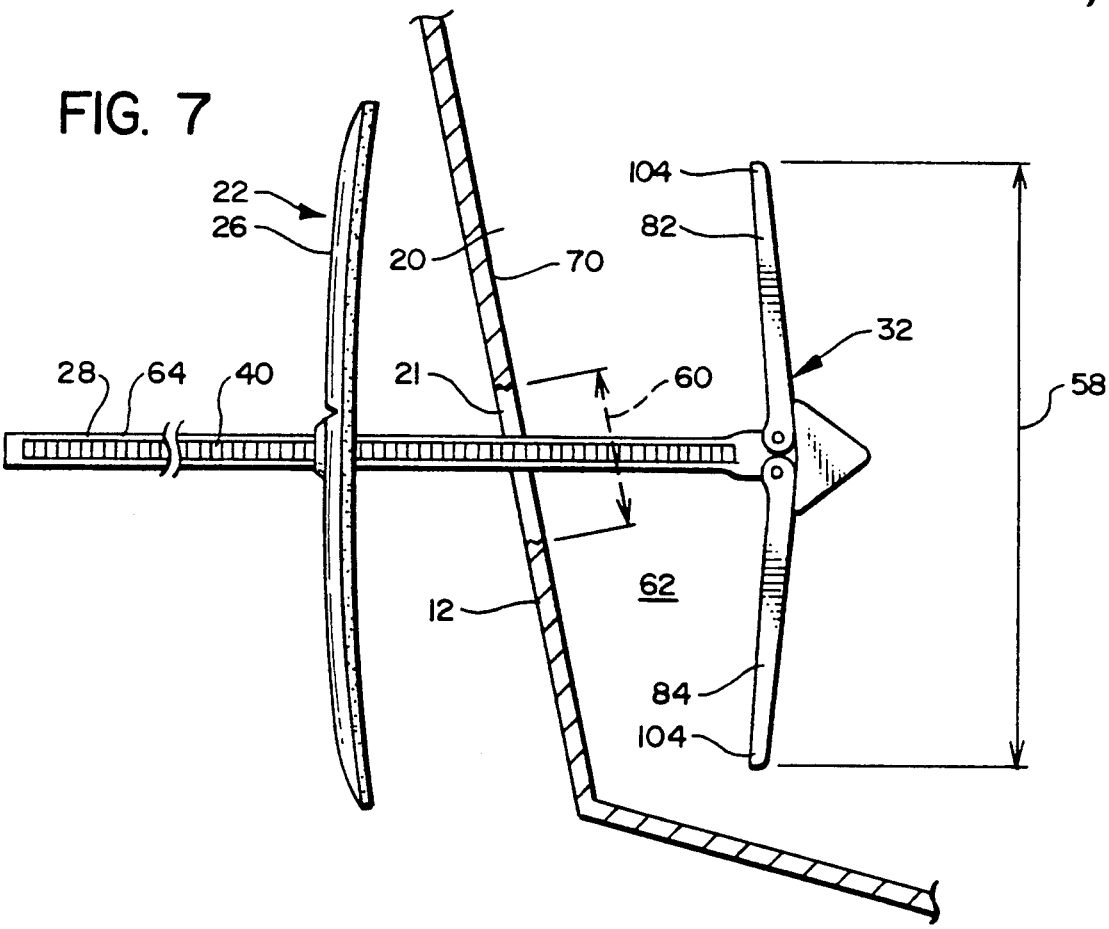
FIG. 7 is a view like FIG. 6 in which the anchor of the apparatus has entered the interior of the ship and has expanded to its retaining position.

The anchor 32 has a first "collapsed" position, as shown in FIG. 6, in which desirably a first anchor width is sufficiently compact to enable the anchor to fit through a narrowest part 56 of the accidental hole 21 in the ship 10, and a second "operating" position, as shown in the related view of FIG. 7, into which the anchor 32 is urged by springs 57. In the operating position, a second anchor width (indicated by the double headed arrow 58) is wider than a width of the accidental hole 21 which is indicated by the double-headed dashed arrow 60. Whenever the anchor 32 (with the strap 28 attached) after entering the accidental hole 21, emerges into an enlarged area 62 within the interior 20 of the ship, the anchor 32 normally expands from its collapsed position to its operating position, so that the anchor 32 is prevented, as shown in the related view of FIG. 8 on the next page, from moving through the accidental hole 21 in a direction of the strap 28.

In FIG. 3 the patching device 22 has been assembled in an assembled position with a free leftward end portion 64 of the strap 28 having been threaded through the strap receiving slot 46. Because the strap is flexible, there is substantial freedom of movement of the anchor 32 relative to the sealing plate 26 and vice versa. As seen in this figure, the patching device 22 is positioned with the sealing plate 26 and the anchor 32 separated so as to have zero interaction with one another, this position of the device being termed its "extended position". Due to the flexibility of the strap the strap 28 is able to be readily moved leftwardly in the figure through the slot 46 merely by grasping and pulling the free end portion 64 of the strap 28. The patching device 22 has another position shown in FIG. 8, in which the free end portion 64 of the strap 28 has been pulled leftwardly as far as it will feasibly go, bringing together the sealing plate 26 and the anchor 32, as close to one another as they are able to be feasibly brought. In this position, the hull 12 becomes clamped tightly between the sealing plate 26 and the anchor 32, so that, the sealing plate 26 (by virtue of the previously described catching action of the catch 48 against the ratchet surface 40) and the anchor 32 (by reason of its being attached to the strap 28) exert, through the strap, opposite clamping forces on one another, these forces being indicated by force arrows 66 and 68, this position of the device being termed its "retracted" position.

Figure 9:
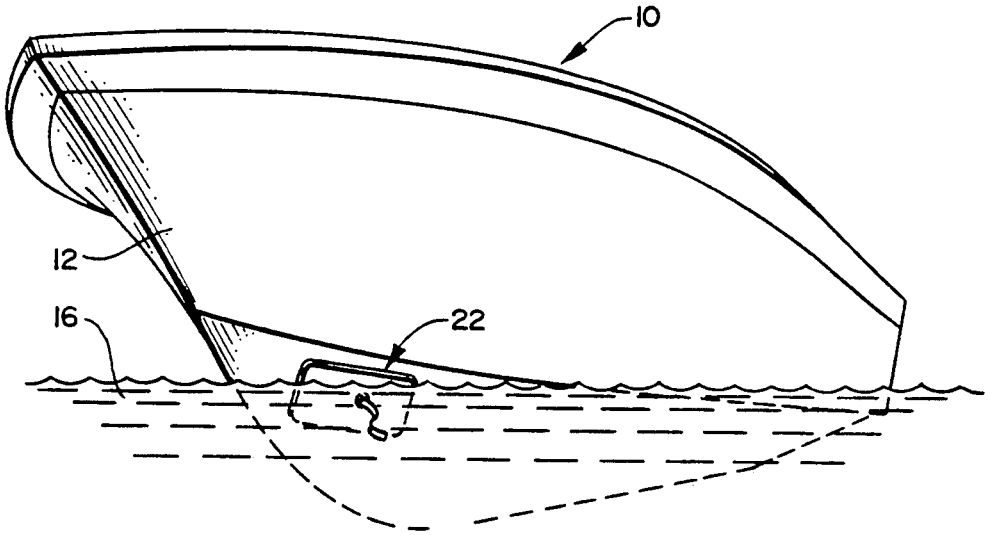
FIG. 9 is a perspective view of the ship of the earlier figures with the patching apparatus in place on its hull.

In overall operation, when it is desired to cover the accidental hole 21 the patching device 22 having first been placed in its extended position, the anchor 32, is inserted into the accidental hole. After the anchor 32 in its collapsed position has been pushed through the narrowest part 56 of the accidental hole and as shown in FIG. 7 has emerged into the enlarged area 62 in the interior 20 of the ship 10, the anchor 32 expands due to the spring biasing of the anchor to its operating position. The position of the sealing plate 26 is adjusted until the sealing plate 26 covers the accidental hole 21, as in FIG. 8. The flexibility of the strap 28 facilitates this movement. The free portion 64 of the flexible strap 28 is then pulled leftwardly in the figure until it is tight, so that the patching device 22 is moved to its retracted position. The anchor 32 in this position bears upon a right inside bearing surface 70 of the ship 10, and the sealing plate 26 bears upon the fluid side 36 of the hull, the sealing plate 26 now forming the fluid tight seal with the hull 12 so that the seawater 16 on the left side of the hull is prevented from leaking into the interior 20 of the ship. The installed device 22 is viewed from outside the ship 10 in FIG. 9.

Figure 5:
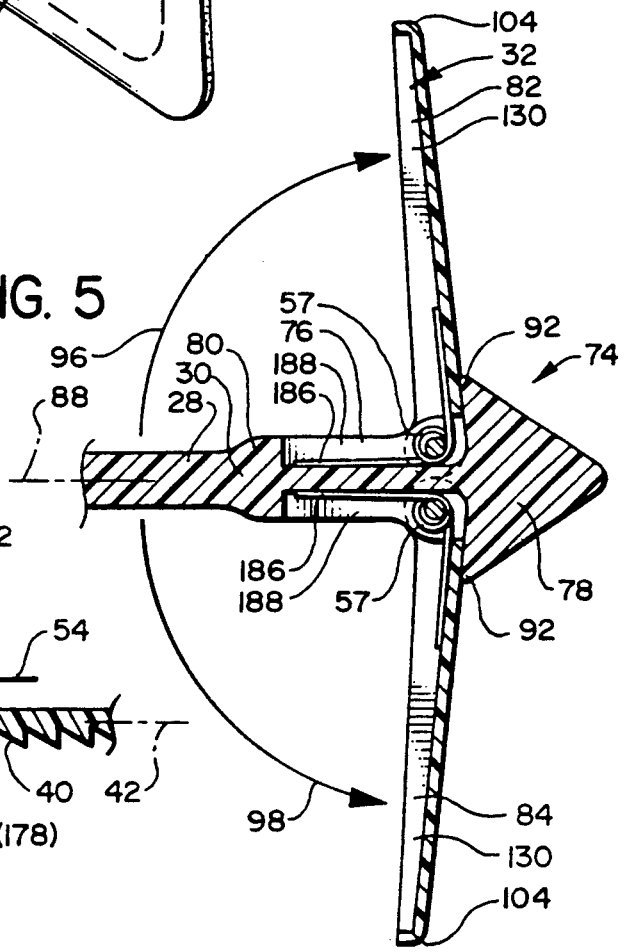
FIG. 5 is an enlarged cross-section taken along the line 5—5 in FIG. 3.

3. Further Refinements and Details. Having described with the example of the patching device 22, certain basic features of the invention, refinements and further technical details will now be provided. These will revolve around:

a. the different arrangements of the anchor;
b. the sealing plate; and
c. the releasability and reusability of the patching device.

a. The Different Arrangements of the Anchor. The anchor 32, already introduced, constitutes a first arrangement 74 of the anchor, which as shown in the detail of FIG. 5, comprises a central trunk portion 76, a rightwardly pointed head portion 78, and a foot portion 80 to which as previously mentioned the strap 28 is attached at 30. There are provided upper and lower pivoting arms 82 and 84 extending from and pivotally attached to the trunk portion 76, the anchor 32 (including the pivoting arms) being symmetrical about a lengthwise anchor axis 88. The pivotal travel of each of the pivoting arms 82 and 84 is limited by ears 92 extending upwardly and downwardly from the head portion 78, so that when the pivoting arms each are rotated rightwardly from the trunk portion 76 to a maximum rotation, indicated by arcs 96 and 98 (as for example about 85° from the lengthwise anchor axis 88) as urged by the spring means 57, outer sides of the pivoting arms 82 and 84 about the ears 92. The anchor 32 is considered to be in its previously described operating position when the pivoting arms 82 and 84 are extended rightwardly to this maximum rotation position. A maximum rotation angle of less than 90° is chosen to assure that in the operating position of the anchor and in the retracted position of the patching device 22, outermost portions 104 of the upper and lower pivoting arms 82 and 84 will bear the force exerted between the anchor 32 and the inside bearing surface 70 of the ship 10, as in FIG. 8. The springs 57 are sufficiently strong to assure that the anchor 32 will expand readily to its operating position when it enters the enlarged area 62 of the interior of the ship, and sufficiently weak to enable a person to fold the arms to their collapsed position shown in FIG. 6.

Figure 10:
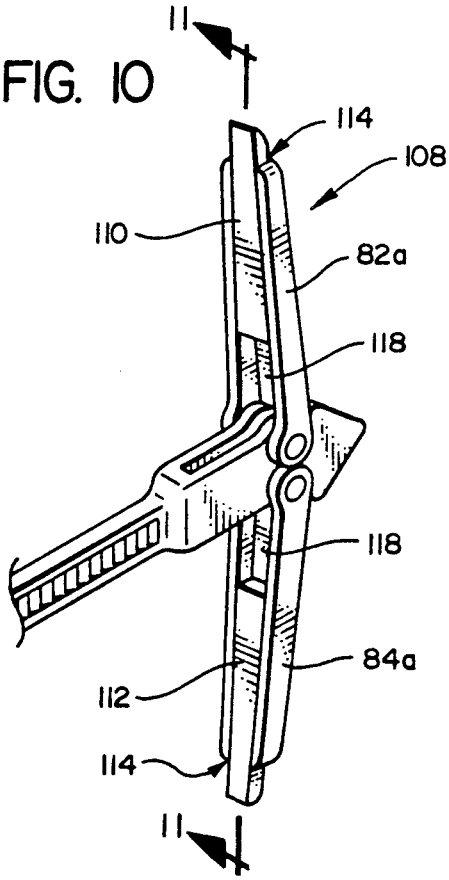
FIG. 10 is a perspective view of a second arrangement of the anchor component.
Figure 11:
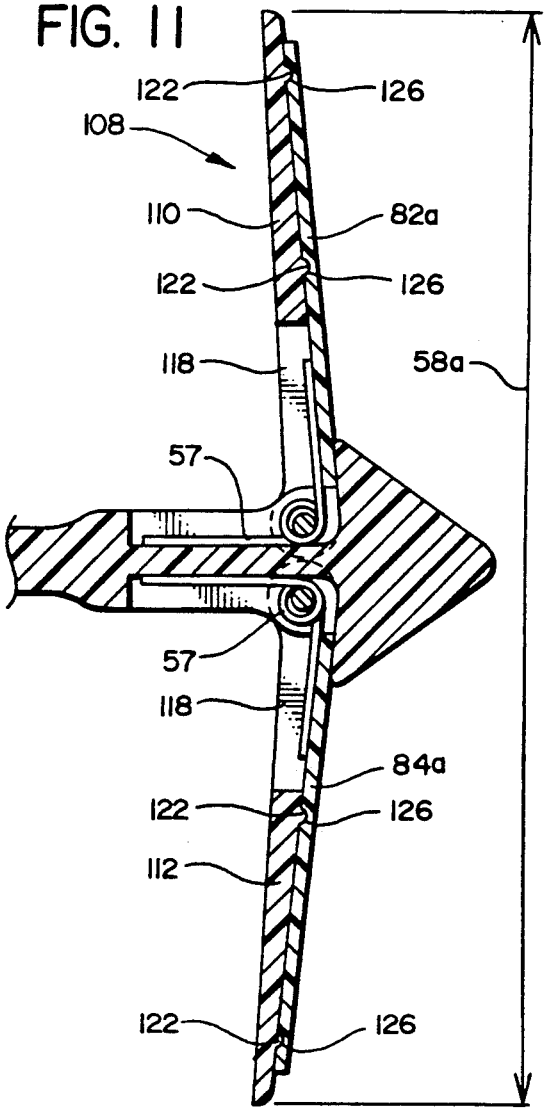
FIG. 11 is a section taken along the line 11—11 in FIG. 10.
Figure 13:
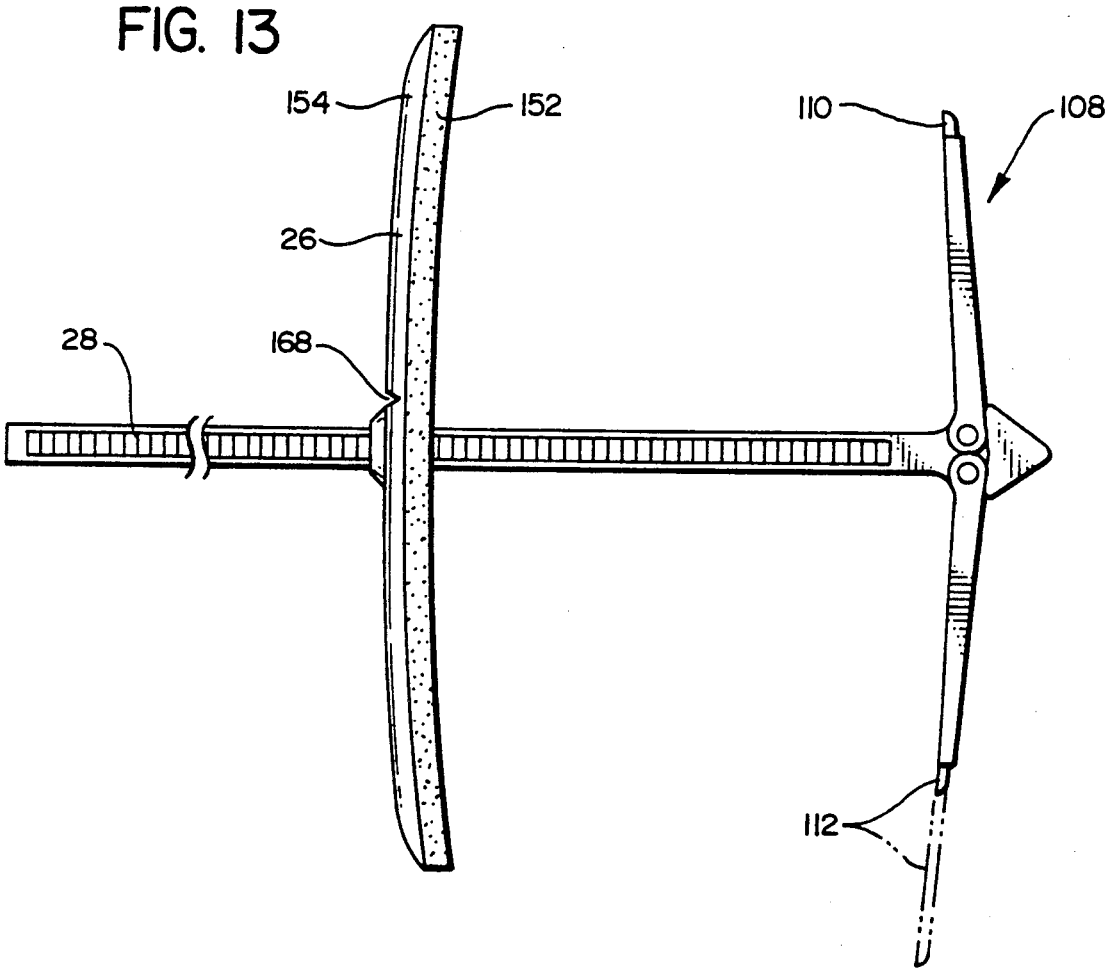
FIG. 13 is a view like FIG. 7 showing different ways that the plate component of the apparatus may be bent.

As shown in the perspective view of FIG. 10 and the section view of FIG. 11, there is a second arrangement 108 of the anchor. Components of the second arrangement which are like those of the earlier first arrangement will have the same numbers in the drawings, but with "a" as a suffix. The second arrangement of the anchor like the first arrangement, comprises the upper and lower pivoting arms 82*a* and 84*a*, but unlike the first arrangement, adds upper and lower telescoping extension members 110 and 112, respectively to each of the pivoting arms 82*a* and 84*a*, respectively. Also, these pivoting arms 82*a* and 84*a* each have openings 114 at outer ends thereof. Each extension member 110 and 112 is adapted to move slideably within a related one of cavities 118 and through a related one of the openings 114 so that each extension member 110 and 112 is able to slide from a retracted position (shown in FIGS. 10 and 11), through an intermediate position, to an extended position (shown for the extension member 112 in FIG. 13), whereby the anchor width indicated by the arrow 58*a* of the anchor 108 may be readily changed. Desirably, each extension member 110 and 112 is held in the desired extension position by detents 122 thereof which engage notches 126 in the pivoting arms.

As shown in FIGS. 3 and 5, each of the upper and lower pivoting arms 82 and 84 of the first arrangement 74 of the anchor 32 also has a related one of upper and lower movable cavities 130. Each of these cavities 130 enables the pivoting arm in the collapsed position to fit over a related one of upper and lower sides 134 and 136 of the trunk portion 76 of the anchor 32 as shown partially in FIG. 6, so as to make the anchor more compact in this position.

b. The Sealing Plate. As shown in the schematic FIG. 12, the hull 12 for purposes of this description is assumed to have both smooth places, such as for example an illustrated flat portion 146, and relatively rough places, such as corners or chines 148. To enable the patching device 22 to be used for covering a breach at a relatively rough place, such as a hole 150 occurring at the chine 148, the sealing plate 26 is formed in a manner to be described presently.

As shown in FIG. 3, the sealing plate 26, which is formed of a right sealing layer 152 and a left backing layer 154 laminated thereto, desirably further comprises an internal form-fitting mesh or loop 156. The loop 156 forms a network that substantially covers the area of the sealing plate 26 and is made of a formable material such as metal wire, that desirably is sufficiently yielding so that it may be formed by hand to conform to the surface of the hull 12. This loop material is sufficiently rigid so that once it is fitted by hand to the shape of the hull surface it holds its shape. Also, this loop material is desirably waterproof. The incorporation of the mesh or loop 156 within the sealing plate 26 makes the sealing plate 26 itself yielding and form-fitting so that the sealing plate 26 is able to form a secure seal.

Figure 12:
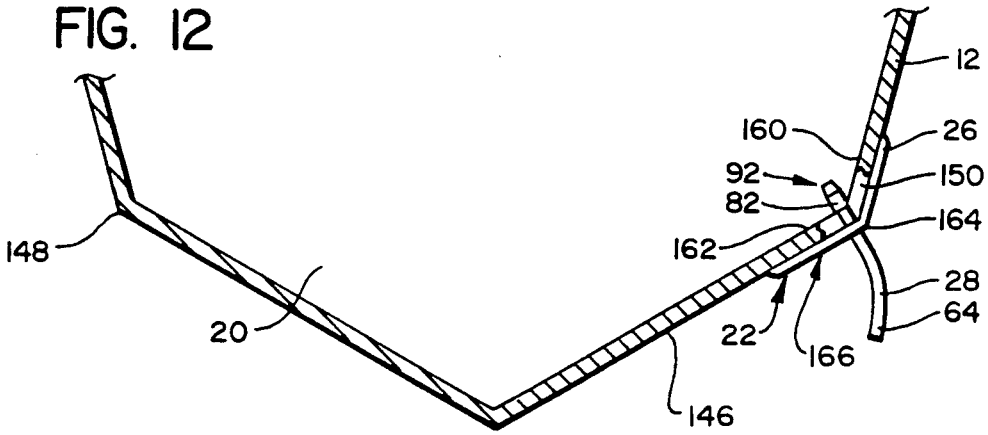
FIG. 12 is a cross-section showing the apparatus attached to the ship to seal a hole located at a corner or chine of the hull.

Returning to FIG. 12, in the course of applying the patching device 22 to the hole 150 at the chine 148 the patching operation is the same as described before, except with the following changes. Just after the anchor 32 passes through the hole 150 and, having entered the enlarged area of the ship's interior, the anchor expands to its operating position, the pivoting arms 82 and 84 one of which (82) is seen from its end in FIG. 12, are seated at a stable position against the inside bearing surface of the hull. In this case the pivoting arms are positioned so that they are cradled by upper and lower sides 160 and 162 of the chine 148. Next, the sealing plate 26 is pressed against the hull 12, starting at an apex 164 of the chine 148, and then all over an area 166 of the plate 26, so that the plate 26 incorporating the loop or mesh 156 becomes form-fitted to the chine 148. Then, as before, the free portion 54 of the strap 28 is pulled so that the patching device 22 assumes its retracted position causing the sealing plate 26 to be clamped firmly against the chine and to cover the hole.

To facilitate the form-fitting of the sealing plate 26 to hard corners such as the chine 148, the backing layer 154 as shown in FIG. 3, has a straight groove 168 which is aligned with a hinge axis 170 of the plate 26, and which is cut part of the way into the thickness of the backing layer 154. This enables the plate 26 to bend toward its sealing layer 152 or toward its backing layer 154 about the hinge axis 170. When the sealing plate 26 as shown in FIG. 12 is to be form-fitted to hard corners, the groove 168 better enables the sealing plate 26 to fit to the chine 148 notwithstanding the fact that the backing layer 154 is desirably made of a semi-rigid material. In this manner, the sealing plate 26 is better form fitted to hard corners.

c. The Releasability and Reusability of the Patching Device. The previously introduced catch 48 (as shown in the detailed section of FIG. 4) which catches the ratchet surface 40 of the strap 28, is preferably integral with a ring 172, within which there is defined the strap receiving slot 46, this ring 172 being itself positioned within an eyelet hole 174 cut in the backing layer 154 of the sealing plate 26. The catch 48 is biased toward the previously described strap receiving area 50 within the slot 46 by the fact that the catch 48 is connected integrally at 176 to the previously introduced biasing means 52 which comprises a resilient neck 178 which protrudes from the inside of the ring 172.

To describe a releasing feature of the invention, a left end of the catch 48 continues (leftwardly and downwardly in the figure) in a release tab 180. This release tab 180 is adapted to be pressed rightwardly and downwardly in the figure, in a manner that the catch 48 becomes disengaged from the ratchet surface 40, so that the catch 48 no longer holds the sealing plate 26 against the ship 10 whereby the patching device 22 may be returned to its extended position. With continued pressing of the release tab 180, the sealing plate 26 may be pulled off of the end of the strap 28 entirely. The anchor 32 and strap 28 attached thereto are able then to be recovered from within the ship 10, so that the patching device 22 may be recovered and the device 22 may be reused.

Figure 4:
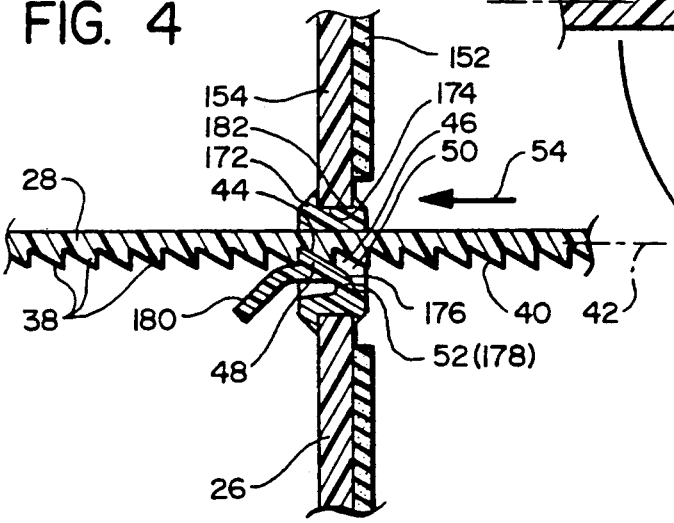
FIG. 4 is an enlarged cross-section taken along the line 4—4 in FIG. 3.

The ring 172 desirably is rotatably mounted within the eyelet hole 174, while, as shown in FIG. 4, the backing layer 154 fits within an annular groove 182 of the ring 172 to form a watertight seal.

Figure 14:
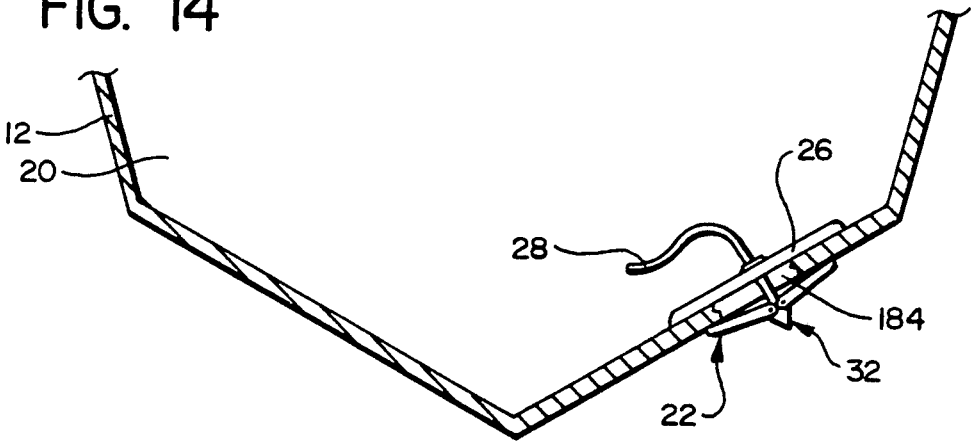
FIG. 14 is another view of the apparatus used on a ship.

Under certain conditions it is desirable for the patching device 22 to be applied as shown in FIG. 14 to a breach 184 in the hull 12 from the interior 20 (rather than from the outside) of the ship 10. In this case, the operative steps are as before, except that the anchor 32 is inserted through breach 184 starting from the interior 20 of the ship then through the breach 184 to the outside where the anchor expands from its collapsed position to its operating position. Then, as before, the sealing plate 26 is pressed against the hull 12 and the strap 28 is pulled until the anchor 32 and the sealing plate 26 are both firmly clamped against the hull 12 as shown in the picture.

The sealing surface 34 of the sealing plate 26 (shown in FIG. 8) desirably is made of a plastic or other material that tends to adhere to the hull surface, which may be made of painted metal, fiberglass, or wood, so as to better form the watertight seal. The sealing surface 34 is also able to be treated with an adhesive, such as a removable type adhesive, that may be formed in a bead (not shown) applied to the sealing surface 34 all around the periphery 158, again to better form the watertight seal.

A stationary leg 186 of each spring 57 is housed in a related spring housing slot 188 in each of the sides of the trunk portion 76 of the anchor 32 as seen in FIG. 5.

The embodiment of the device, which is illustrated as being used to cover breaches in ship hulls, may also be used for various other patching operations where the problems involved are similar to those illustrated here.

It is to be understood that different modifications may be made of the foregoing description without departing from the basic teachings of the invention.

What is claimed is:

1. An apparatus for covering breaks, cracks, holes, and other breaches, in a wall means of a container such as a ship hull, comprising:

a. a plate means adapted to be pressed against said wall means and to cover over said breach in a manner to form a seal against a containable fluid;

b. a substantially flexible strap means a first free end portion of which is able to be pulled through a strap securing means included in said plate means;

c. an anchor means being fixed to a second end of said strap means and comprising one or more arm means which are able to be collapsed into a first collapsed position or extended into a second operating position where said arm means extend from a hub means of said anchor means and a spring means of said anchor means urges said arm means into said operating position; whereby said anchor means may pass through said breach when said arm means are in the collapsed position and said spring means urges said arms into said operating position on the other side of said breach;

said plate means has substantial freedom of movement relative to said anchor means and is able to be positioned to cover said breach; and said strap means is able to be pulled through said strap securing means so as to tighten said plate means against said wall means with said plate means forming said seal against said containable fluid.

2. A method for covering a breach in a wall means of a container such as a ship hull, said method comprising the following steps:

a. providing a plate means adapted to be pressed against said wall means and to cover over said breach in a manner to form a seal against a containable fluid;

b. providing a substantially flexible strap means;

c. providing an anchor means being fixed to a first end of said strap means and comprising one or more arm means which are able to be collapsed into a first collapsed position or extended into a second operating position where said arm means extend from a hub means of said anchor means;

d. running a second free end portion of said strap means through a strap securing means included in said plate means;

e. inserting said anchor means in its collapsed position at a first side of said wall means through said breach;

f. urging said arm means of said anchor means into said extended position on a second opposed side of said wall means;

g. positioning said plate means against said wall means in a manner to cover over said breach;

h. pulling said free and portion of said strap means through said strap securing means in a manner to clamp said plate means against said wall means to form said seal against said containable fluid.

3. An apparatus for covering a breach in a wall of a container such as a ship hull, comprising:

a sealing plate which has a preforation formed therein and which is adapted to conform to the container wall to seal the breach;

a catch means which is attached to the sealing plate and which extends into the perforation;

a flexible strap having at least one ratchet means extending therefrom; and an anchor means secured to one end of the flexible strap; whereby the catch means engages the ratchet means to prevent the flexible strap from being drawn in a first direction through the perforation.

4. A breach covering apparatus as defined in claim 3, wherein the catch means engages the ratchet means in a manner that allows the strap to be drawn in a second direction through the perforation.

5. A breach covering apparatus as defined in claim 3, wherein the anchor means is attached to the end of the flexible strap that is in the first direction.

6. A breach covering apparatus as defined in claim 3, in which the catch means comprises a catch projection biased int the perforation, where the catch projection has a first catch surface and the ratchet means has at least one first ratchet surface, where the first catch surface engages the first ratchet surface to prevent the strap from being pulled in the first direction.

7. A breach covering apparatus as defined in claim 6, in which the catch projection has a second catch surface and the ratchet means further has a second ratchet surface, where the second catch surface slidingly engages the second ratchet surface to force the catch projection against the bias thereon to allow the strap to be pulled in a second direction through the perforation.

8. A breach covering apparatus as defined in claim 6, in which the catch projection has a release projection extending therefrom that allows the catch projection to be manually forced against the bias thereon to disengage the first catch surface from the first ratchet surface to allow the strap to be pulled in a second direction through the perforations.

9. A breach covering apparatus as defined in claim 3, further comprising a sealing means for preventing fluid from passing through the perforation around the flexible strap.

10. A breach covering apparatus as defined in claim 9, in which the sealing means comprises a sealing ring having an annular groove formed therearound adapted to receive an edge of the sealing plate around the perforation and a slot adapted to receive the flexible strap.

11. A breach covering apparatus as defined in claim 10, in which the catch means is integrally formed with the sealing ring and forms one side of the sot that receives the flexible strap.

12. A breach covering apparatus as defined in claim 3, in which the anchor means comprises:

a plurality of anchor arms;

a plurality of biasing means for biasing the anchor arms towards an operating position; and a head portion having projections for contacting and bracing the anchor arms when the anchor arms are in the operating position.

13. A breach covering apparatus as defined in claim 3, in which the anchor means comprises:

a plurality of anchor arms; and a plurality of extension members which telescope from the anchor arms to extend the reach thereof.

14. A breach covering apparatus as defined in claim 3, in which the sealing plate may be formed by hand to allow the sealing plate to be fitted to the shape of the container wall at the braech.

15. A breach covering apparatus as defined in claim 14, in which the sealing plate comprises:

a sealing layer;

a semi-rigid backing layer; and a mesh layer laminated between the sealing and backing layers, where the mesh layer is made of formable material such as metal wire.

16. A breach covering apparatus as defined in claim 14, in which a groove is formed on the sealing plate to allow the sealing plate to be folded to conform to corners of the container wall.

17. An method of covering a breach in a wall of a container such as a ship hull, comprising the steps of:

providing a perforated sealing plate adapted to conform to the container wall to seal the breach, a catch projection attached to the sealing plate and biased into the perforation, a flexible strap having at least one ratchet projection extending therefrom which engages the catch projection to prevent the flexible strap from being pulled in a first direction through the perforation and which allows the flexible strap to be pulled in a second direction through the perforation, and an anchor secured to a first end of the flexible strap;

inserting a second end of the flexible strap in the second direction through the perforation;

passing the anchor through the breach in the container wall;

positioning the sealing plate against the breach; and pulling the second end of the flexible strap in the second direction until the anchor engages the container wall.

18. A breach covering method as defined in claim 17, further comprising the step of:

providing a release projection on the catch projection; and applying a manual force on the release projection to force the catch projection against the bias thereon to allow the flexible strap to be pulled in the first direction through the perforation.

19. A breach covering method as defined in claim 17, further comprising the steps of:

providing a plurality of anchor arms on the anchor, where each anchor arm may be collapsed into a first position or extended into a second position by biasing springs;

providing a head portion on the anchor, where the head portion has projections for contacting the anchor arms when the anchor arms are in the second position; and collapsing the anchor arms into the first position before the step of passing the anchor through the breach.

20. A breach covering method as defined in claim 19, further comprising the steps of:

providing a plurality of extension members which telescope from the anchor arms into an extended position; and extending the extension members into the extended position to extend a width of the anchor.

21. A breach covering method as defined in claim 17, further comprising the steps of forming a groove on the sealing plate and so bending the sealing plate at the groove that the sealing plate is form fitted to a corner of the container wall.

* * * * *